US009153237B2

(12) United States Patent
Jeon et al.

(10) Patent No.: US 9,153,237 B2
(45) Date of Patent: Oct. 6, 2015

(54) AUDIO SIGNAL PROCESSING METHOD AND DEVICE

(71) Applicants: LG ELECTRONICS INC., Seoul (KR); INDUSTRY-ACADEMIC COOPERATION FOUNDATION, YONSEI UNIVERSITY, Seoul (KR)

(72) Inventors: Hye Jeong Jeon, Seoul (KR); Dae Hwan Kim, Seoul (KR); Hong Goo Kang, Seoul (KR); Min Ki Lee, Seoul (KR); Byung Suk Lee, Seoul (KR); Gyu Hyeok Jeong, Seoul (KR)

(73) Assignees: LG Electronics Inc., Seoul (KR); Industry-Academic Cooperation Foundation, Yonsei University, Seoul (KR)

( * ) Notice: Subject to any disclaimer, the term of this patent is extended or adjusted under 35 U.S.C. 154(b) by 0 days.

(21) Appl. No.: 14/687,991

(22) Filed: Apr. 16, 2015

(65) Prior Publication Data

US 2015/0221311 A1 Aug. 6, 2015

Related U.S. Application Data

(63) Continuation of application No. 13/511,331, filed as application No. PCT/KR2010/008336 on Nov. 24, 2010, now Pat. No. 9,020,812.

(60) Provisional application No. 61/264,248, filed on Nov. 24, 2009, provisional application No. 61/285,183, filed on Dec. 10, 2009, provisional application No. 61/295,166, filed on Jan. 15, 2010.

(51) Int. Cl.
*G10L 11/00* (2006.01)
*G10L 19/14* (2006.01)

(Continued)

(52) U.S. Cl.
CPC ..... *G10L 19/00* (2013.01); *G10L 2019/0001* (2013.01)

(58) Field of Classification Search
USPC ..... 704/207, 208, 219, 202, 205, 223, 262, 704/264, 265, 266, 500, E19.029
See application file for complete search history.

(56) References Cited

U.S. PATENT DOCUMENTS 5,305,332 A * 4/1994 Ozawa ..... 714/747
5,450,449 A * 9/1995 Kroon ..... 375/350

(Continued)

FOREIGN PATENT DOCUMENTS

CN 101268351 A 9/2008
KR 10-2004-0050810 A 6/2004

(Continued)

OTHER PUBLICATIONS

PCT International Search Report dated Aug. 10, 2011 for Application No. PCT/KR2010/008336, w/English translation, 4 pages.

(Continued)

*Primary Examiner* — Edgar Guerra-Erazo
(74) *Attorney, Agent, or Firm* — Fish & Richardson P.C.

(57) ABSTRACT

Disclosed is an audio signal processing method comprising the steps of: receiving an audio signal containing current frame data; generating a first temporary output signal for the current frame when an error occurs in the current frame data, by carrying out frame error concealment with respect to the current frame data a random codebook; generating a parameter by carrying out one or more of short-term prediction, long-term prediction and a fixed codebook search based on the first temporary output signal; and memory updating the parameter for the next frame; wherein the parameter comprises one or more of pitch gain, pitch delay, fixed codebook gain and a fixed codebook.

8 Claims, 10 Drawing Sheets

(51) Int. Cl.

| | |
|---|---|
| ***G10L 13/00*** | (2006.01) |
| ***G10L 13/06*** | (2013.01) |
| ***G10L 19/00*** | (2013.01) |

(56) References Cited

U.S. PATENT DOCUMENTS

| | | | | |
|---|---|---|---|---|
| 5,615,298 | A | 3/1997 | Chen | |
| 5,699,478 | A | 12/1997 | Nahumi | |
| 5,778,338 | A * | 7/1998 | Jacobs et al. | 704/223 |
| 5,828,811 | A | 10/1998 | Taniguchi | |
| 6,052,660 | A * | 4/2000 | Sano | 704/221 |
| 6,085,158 | A * | 7/2000 | Naka et al. | 704/228 |
| 6,226,604 | B1 | 5/2001 | Ehara | |
| 6,385,578 | B1 * | 5/2002 | Lee et al. | 704/225 |
| 6,584,438 | B1 * | 6/2003 | Manjunath et al. | 704/228 |
| 6,597,961 | B1 | 7/2003 | Cooke | |
| 6,636,829 | B1 * | 10/2003 | Benyassine et al. | 704/201 |
| 6,665,637 | B2 | 12/2003 | Bruhn | |
| 6,810,377 | B1 * | 10/2004 | Ho et al. | 704/208 |
| 6,856,955 | B1 | 2/2005 | Ozawa | |
| 6,910,009 | B1 | 6/2005 | Murashima | |
| 7,146,309 | B1 * | 12/2006 | Benyassine et al. | 704/201 |
| 7,191,123 | B1 | 3/2007 | Bessette | |
| 7,519,535 | B2 | 4/2009 | Spindola | |
| 7,590,531 | B2 | 9/2009 | Khalil | |
| 7,613,606 | B2 | 11/2009 | Makinen | |
| 7,831,421 | B2 | 11/2010 | Khalil | |
| 7,873,515 | B2 * | 1/2011 | Padhi et al. | 704/228 |
| 7,962,335 | B2 | 6/2011 | Khalil | |
| 8,214,203 | B2 * | 7/2012 | Sung et al. | 704/219 |
| 2002/0091523 | A1 | 7/2002 | Makinen | |
| 2004/0117178 | A1 | 6/2004 | Ozawa | |
| 2005/0154584 | A1 | 7/2005 | Jelinek | |
| 2006/0173687 | A1 | 8/2006 | Spindola | |
| 2006/0271359 | A1 | 11/2006 | Khalil | |
| 2006/0271373 | A1 | 11/2006 | Khalil | |
| 2007/0271480 | A1 | 11/2007 | Oh | |
| 2008/0270124 | A1 | 10/2008 | Son | |
| 2009/0276212 | A1 | 11/2009 | Khalil | |

FOREIGN PATENT DOCUMENTS

| | | | |
|---|---|---|---|
| KR | 10-2007-0091512 | A | 9/2007 |
| KR | 10-2007-0099055 | A | 10/2007 |
| KR | 10-2008-0011186 | A | 1/2008 |
| WO | WO 2006/083826 | A1 | 8/2006 |
| WO | WO 2006/130236 | A2 | 12/2006 |

OTHER PUBLICATIONS

European Search Report dated Nov. 28, 2013 for Application No. 10833553, 6 pages.

Peter Kroon et al. "Performance of the Proposed ITU-T 8 KB/S Speech Standard for a Rayleigh Fading Channel", 19950920; 19950920-19950922, Sep. 20, 1995, pp. 11-12, XP010269469, p. 12, "4. Error Concealment Procedure".

Frank Mertz et al. "Voicing Controlled Frame Less Concealment for Adaptive Multi-Rate (AMR) Speech Frames in Voice-over-IP", Sep. 1, 2003, p. 1077, XP007006831, p. 1078, left-hand column, line 17-p. 1079, right-hand column, last line.

* cited by examiner

AUDIO SIGNAL PROCESSING METHOD AND DEVICE

CROSS REFERENCE TO RELATED APPLICATIONS

This application is a continuation of U.S. application Ser. No. 13/511,331, filed May 22, 2012, now allowed, which is a U.S. National Phase of International Application PCT/KR2010/008336, filed on Nov. 24, 2010, which claims the benefit of U.S. Provisional Application No. 61/264,248, filed on Nov. 24, 2009, U.S. Provisional Application No. 61/285,183, filed on Dec. 10, 2009 and U.S. Provisional Application No. 61/295,166, filed on Jan. 15, 2010, all of which are hereby incorporated by reference in their entireties.

DESCRIPTION

1. Technical Field

The present invention relates to an audio signal processing method and device which can encode or decode audio signals.

2. Background Art

Transmission of audio signals, especially transmission of speech signals, improves as encoding and decoding delay of speech signals decreases since the purpose of transmission of speech signals is often real-time communication.

DISCLOSURE

Technical Problem

When a speech signal or an audio signal is transmitted to a receiving side, an error or loss may occur causing a reduction in audio quality.

Technical Solution

The present invention has been made in order to overcome such problem and it is an object of the present invention to provide an audio signal processing method and device for concealing frame loss at a receiver.

It is another object to provide an audio signal processing method and device for minimizing propagation of an error to a next frame due to a signal that is arbitrarily generated to conceal frame loss.

Advantageous Effects

The present invention provides the following advantages and benefits.

First, since a receiver-based loss concealment method is performed, bits for additional information for frame error concealment are not required and therefore it is possible to efficiently conceal loss even in a low bit rate environment.

Second, when a current loss concealment method is performed, it is possible to minimize propagation of an error to a next frame and therefore it is possible to prevent audio quality degradation as much as possible.

BEST MODE

Figure 1:
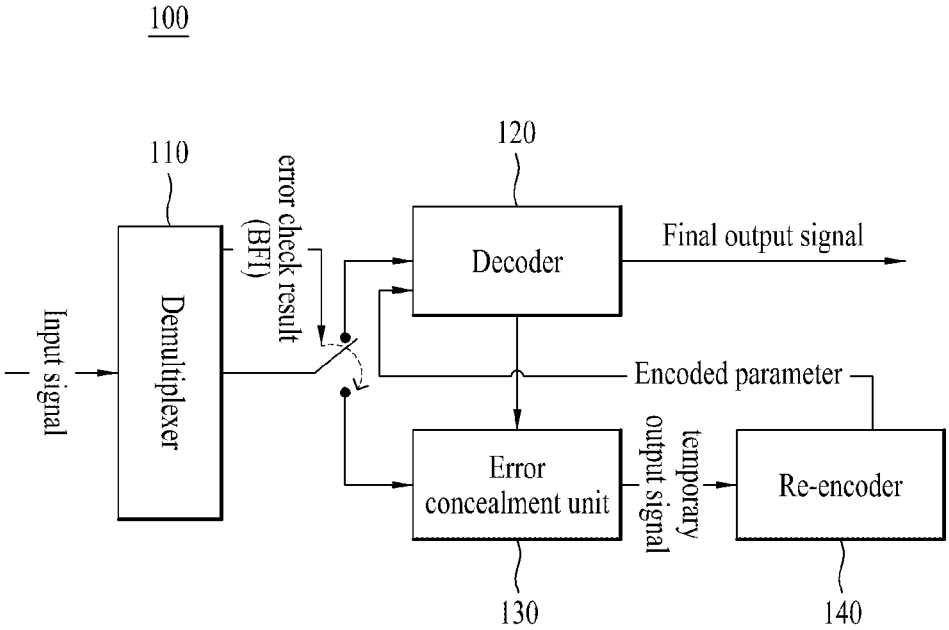
FIG. 1 is a block diagram of an audio signal processing device according to an embodiment of the present invention.

An audio signal processing method according to the present invention to accomplish the above objects includes receiving an audio signal including data of a current frame, performing, when an error has occurred in the data of the current frame, frame error concealment on the data of the current frame using a random codebook to generate a first temporary output signal of the current frame, performing at least one of short term prediction, long term prediction, and fixed codebook search based on the first temporary output signal to generate a parameter, and updating a memory with the parameter for a next frame, wherein the parameter includes at least one of a pitch gain, a pitch delay, a fixed codebook gain, and a fixed codebook.

According to the present invention, the audio signal processing method may further include performing, when an error has occurred in the data of the current frame, extrapolation on a past input signal to generate a second temporary output signal, and selecting the first temporary output signal or the second temporary output signal according to speech characteristics of a previous frame, wherein the parameter may be generated by performing at least one of short term prediction, long term prediction, and fixed codebook search on the selected temporary output signal.

According to the present invention, the speech characteristics of the previous frame may be associated with whether voiced sound characteristics or unvoiced sound characteristics of the previous frame are greater and the voice sound characteristics may be greater when the pitch gain is high and the pitch delay changes little.

According to the present invention, the memory may include a memory for long term prediction and a memory for short term prediction and includes a memory used for parameter quantization of a prediction scheme.

According to the present invention, the audio signal processing method may further include generating a final output signal of the current frame by performing at least one of fixed codebook acquisition, adaptive codebook synthesis, and short term synthesis using the parameter.

According to the present invention, the audio signal processing method may further include updating the memory with the final output signal and an excitation signal acquired through the long term synthesis and fixed codebook synthesis.

According to the present invention, the audio signal processing method may further include performing at least one of long term synthesis and short term synthesis on a next frame based on the memory when no error has occurred in data of the next frame.

An audio signal processing device according to the present invention to accomplish the above objects includes a demultiplexer for receiving an audio signal including data of a current frame and checking whether or not an error has occurred in the data of the current frame, an error concealment unit for performing, when an error has occurred in the data of the current frame, frame error concealment on the data of the current frame using a random codebook to generate a first temporary output signal of the current frame, a re-encoder for performing at least one of short term prediction, long term prediction, and fixed codebook search based on the first temporary output signal to generate a parameter, and a decoder for updating a memory with the parameter for a next frame, wherein the parameter includes at least one of a pitch gain, a pitch delay, a fixed codebook gain, and a fixed codebook.

According to the present invention, the error concealment unit may include an extrapolation unit for performing, when an error has occurred in the data of the current frame, extrapolation on a past input signal to generate a second temporary output signal, and a selector for selecting the first temporary output signal or the second temporary output signal according to speech characteristics of a previous frame, wherein the parameter may be generated by performing at least one of short term prediction, long term prediction, and fixed codebook search on the selected temporary output signal.

According to the present invention, the speech characteristics of the previous frame may be associated with whether voiced sound characteristics or unvoiced sound characteristics of the previous frame are greater and the voice sound characteristics may be greater when the pitch gain is high and the pitch delay changes little.

According to the present invention, the memory may include a memory for long term prediction and a memory for short term prediction and includes a memory used for parameter quantization of a prediction scheme.

According to the present invention, the decoder may generate a final output signal of the current frame by performing at least one of fixed codebook acquisition, adaptive codebook synthesis, and short term synthesis using the parameter.

According to the present invention, the decoder may update the memory with the final output signal and an excitation signal acquired through the long term synthesis and fixed codebook synthesis.

According to the present invention, the decoder may perform at least one of long term synthesis and short term synthesis on a next frame based on the memory when no error has occurred in data of the next frame.

MODE FOR INVENTION

Preferred embodiments of the present invention will now be described in detail with reference to the accompanying drawings. Prior to the description, it should be noted that the terms and words used in the present specification and claims should not be construed as being limited to common or dictionary meanings but instead should be understood to have meanings and concepts in agreement with the spirit of the present invention based on the principle that an inventor can define the concept of each term suitably in order to describe his/her own invention in the best way possible. Thus, the embodiments described in the specification and the configurations shown in the drawings are simply the most preferable examples of the present invention and are not intended to illustrate all aspects of the spirit of the present invention. As such, it should be understood that various equivalents and modifications can be made to replace the examples at the time of filing of the present application.

The following terms used in the present invention may be construed as described below and other terms, which are not described below, may also be construed in the same manner. A term "coding" may be construed as encoding or decoding as needed and "information" is a term encompassing values, parameters, coefficients, elements, and the like and the meaning thereof varies as needed although the present invention is not limited to such meanings of the terms.

Here, in the broad sense, the term "audio signal" is distinguished from "video signal" and indicates a signal that can be audibly identified when reproduced. In the narrow sense, the term "audio signal" is discriminated from "speech signal" and indicates a signal which has little to no speech characteristics. In the present invention, the term "audio signal" should be construed in the broad sense and, when used as a term distinguished from "speech signal", the term "audio signal" may be understood as an audio signal in the narrow sense.

In addition, although the term "coding" may indicate only encoding, it may also have a meaning including both encoding and decoding.

Figure 2:
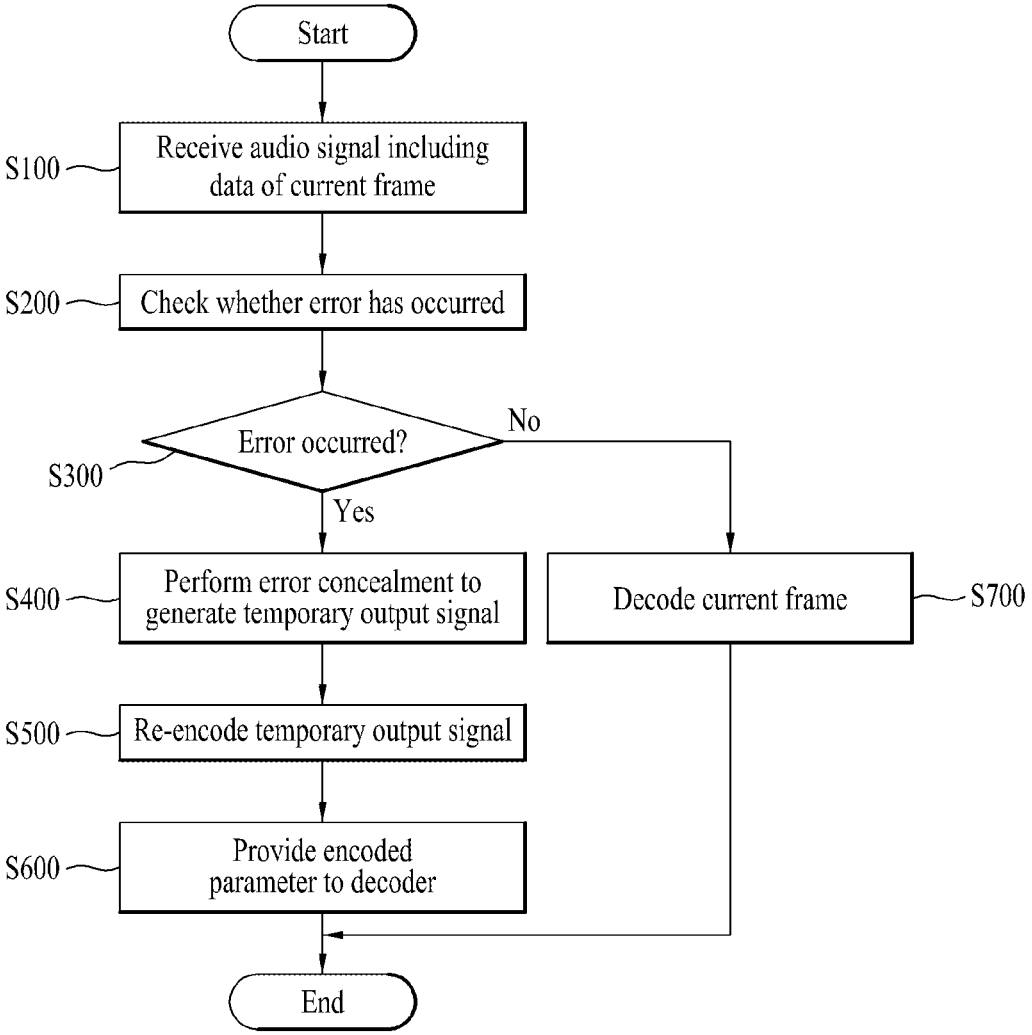
FIG. 2 is a flowchart of an audio signal processing method according to an embodiment of the present invention.

FIG. 1 is a block diagram of an audio signal processing device according to an embodiment of the present invention and FIG. 2 is a flowchart of an audio signal processing method according to an embodiment of the present invention.

First, as shown in FIG. 1, the audio signal processing device 100 according to the embodiment of the present invention includes an error concealment unit 130 and a re-encoder 140 and may further include a demultiplexer 110 and a decoder 120. Each of the components of the audio signal processing device 100 is described below with reference to FIGS. 1 and 2.

The demultiplexer 110 receives an audio signal including data of a current frame through a network (S100). Here, the demultiplexer 110 performs channel encoding on a packet of the received audio signal and checks whether or not an error has occurred (S200). Then, the demultiplexer 110 provides the received data of the current frame to the decoder 120 or the error concealment unit 130 according to a bad frame indicator (BFI) which is an error check result. Specifically, the demultiplexer 110 provides the data of the current frame to the error concealment unit 130 when an error has occurred (yes in step S300) and provides the data of the current frame to the decoder 120 when no error has occurred (no in step S300).

Then, the error concealment unit 130 performs error concealment on the current frame using a random codebook and past information to generate a temporary output signal (S400). A procedure performed by the error concealment unit 130 will be described later in detail with reference to FIGS. 3 to 5.

The re-encoder 140 performs re-encoding on the temporary output signal to generate an encoded parameter (S500). Here, re-encoding may include at least one of short-term prediction, long-term prediction, and codebook search and the parameter may include at least one of a pitch gain, pitch delay, a fixed codebook gain, and a fixed codebook. A detailed configuration of the re-encoder 140 and step S500 will be described later in detail with reference to FIGS. 6 and 7. The re-encoder 140 provides the encoded parameter to the decoder 120 (S600).

When it is determined in step S300 that no error has occurred (i.e., no in step S300), the decoder 120 performs decoding on data of the current frame extracted from a bitstream (S700) or performs decoding based on the encoded parameter of the current frame received from the re-encoder 140 (S700). Operation of the decoder 120 and step S700 will be described later in detail with reference to FIGS. 8 to 10.

Figure 3:
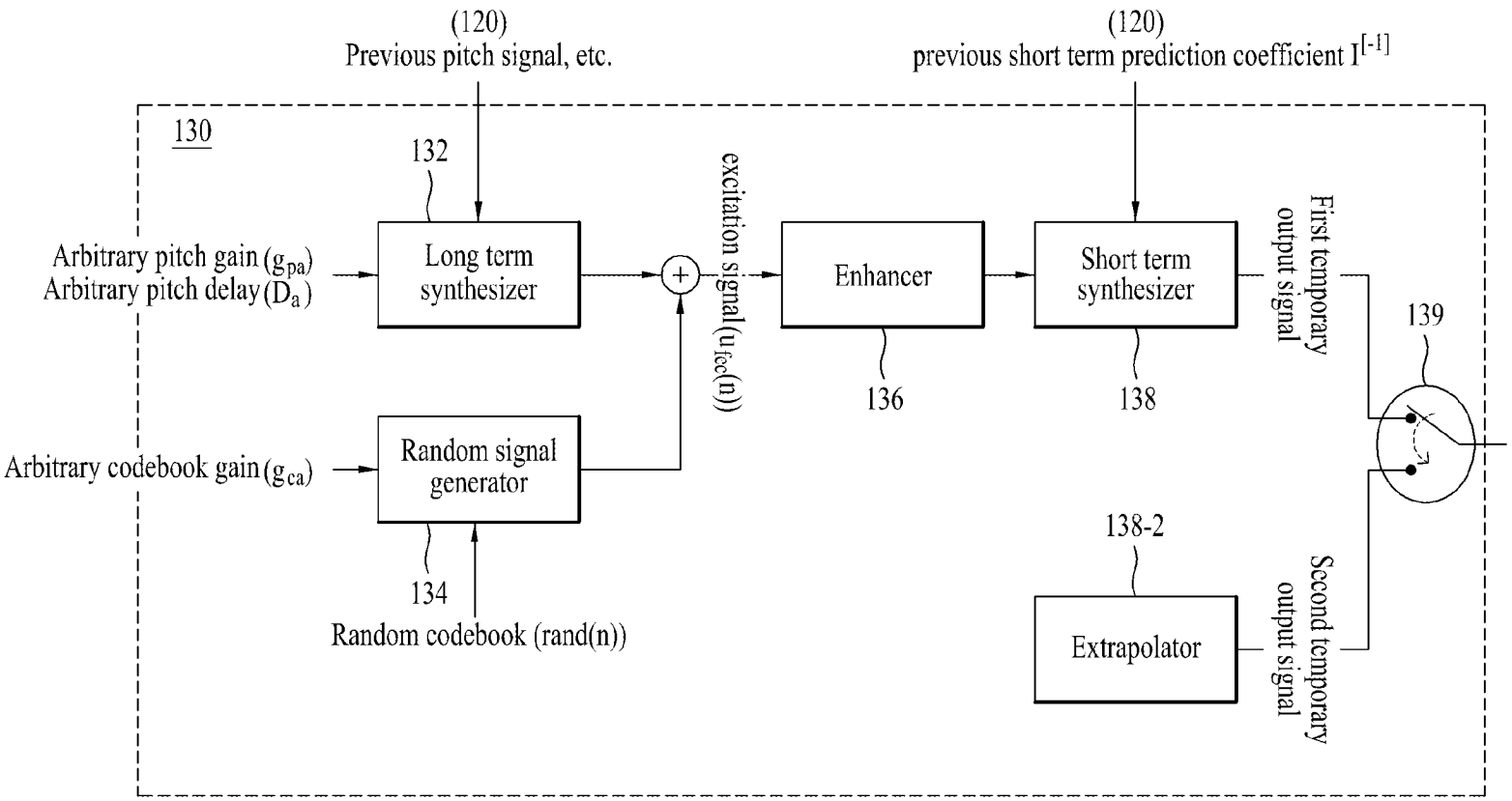
FIG. 3 is a detailed block diagram of an error concealment unit 130 according to an embodiment of the present invention.
Figure 4:
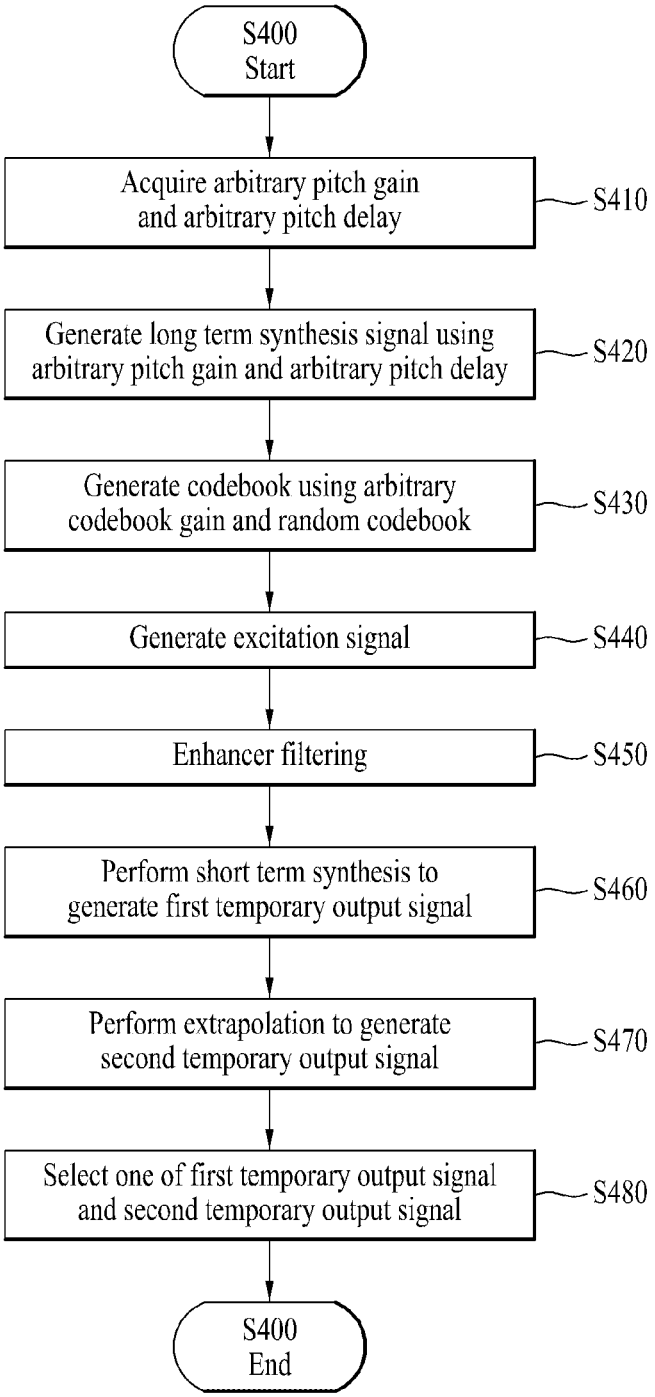
FIG. 4 is a flowchart of error concealment step S400.
Figure 5:
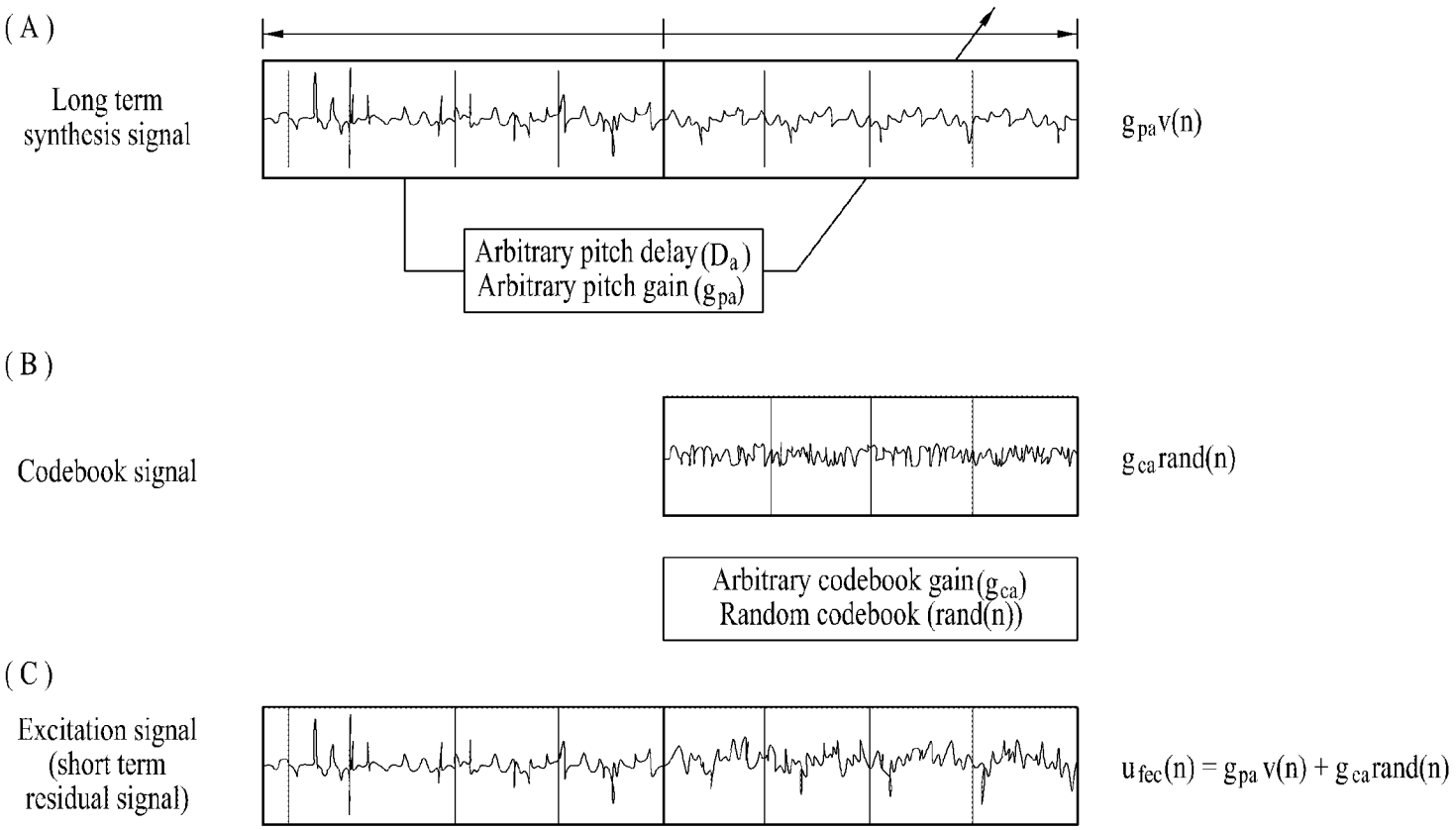
FIG. 5 illustrates a signal generated by an error concealment unit according to an embodiment of the present invention.

FIG. 3 is a detailed block diagram of the error concealment unit 130 according to an embodiment of the present invention, FIG. 4 is a flowchart of the error concealment step S400, and FIG. 5 illustrates a signal generated by the error concealment unit according to an embodiment of the present invention.

First, as shown in FIG. 3, the error concealment unit 130 may include an error concealment unit 130, a long term synthesizer 132, a random signal generator 134, an enhancer 136, an enhancer 136, an extrapolator 138-2, and a selector 139. A detailed configuration of the error concealment unit 130 is described below with reference to FIGS. 3 and 4.

First, the long term synthesizer 132 acquires an arbitrary pitch gain $g_{pa}$ and an arbitrary pitch delay $D_a$ (S410). The pitch gain and the pitch delay are parameters that are generated through long term prediction (LTP) and the LTP filter may be expressed by the following expression.

[Expression 1]

$$\frac{1}{P(z)} = \frac{1}{1 - g_p z^{-D}} \quad \text{[Expression 1]}$$

Here, $g_p$ denotes the pitch gain and D denotes the pitch delay.

That is, the received pitch gain and the received pitch delay, which may constitute an adaptive codebook, are substituted into Expression 1. Since the pitch gain and the pitch delay of the received data of the current frame may contain an error, the long term synthesizer 132 acquires the arbitrary pitch gain $g_{pa}$ and the arbitrary pitch delay $D_a$ for replacing the received pitch gain and the received pitch delay. Here, the arbitrary pitch gain $g_{pa}$ may be equal to a pitch gain value of a previous frame and may also be calculated by weighting the most recent gain value from among gain values stored in previous frames by a weight although the present invention is not limited thereto. The arbitrary pitch gain $g_{pa}$ may also be obtained by appropriately reducing the weighted gain value according to characteristics of the speech signal. The arbitrary pitch delay da may also be equal to that of data of a previous frame although the present invention is not limited thereto.

In the case in which data of a previous frame is used to generate the arbitrary pitch gain $g_{pa}$ and the arbitrary pitch delay $D_a$, a value (not shown) received from a memory of the decoder 120 may be used.

An adaptive codebook is generated using the arbitrary pitch gain $g_{pa}$ and the arbitrary pitch delay $D_a$ acquired in step S410, for example, by substituting the arbitrary pitch gain $g_{pa}$ and the arbitrary pitch delay $D_a$ into Expression 1 (S420). Here, a past excitation signal of a previous frame received from the decoder 120 may be used in step S420. FIG. 5(A) illustrates an exemplary long term synthesized signal $g_{pa}v(n)$ generated based on the arbitrary pitch delay and the arbitrary pitch gain and a long term synthesized signal (adaptive codebook) of a previous frame.

Referring back to FIGS. 3 and 4, the random signal generator 134 generates a signal $g_{ca}rand(n)$ for replacing the fixed codebook using arbitrary codebook gain $g_{ca}$ and a random codebook rand(n) (S430). Here, the arbitrary codebook gain $g_{ca}$ may also be calculated by weighting the most recent gain value from among gain values stored in previous frames by a weight and may also be calculated by appropriately reducing the weighted gain value according to characteristics of the speech signal. However, the present invention is not limited to these calculation methods.

FIG. 5(B) illustrates an exemplary fixed codebook signal $g_{ca}rand(n)$ generated using a random codebook rand(n) and an arbitrary codebook gain $g_{ca}$. Referring back to FIGS. 3 and 4, an error-concealed excitation signal $u_{fec}(n)$ is generated using the LTP synthesized signal generated in step S420 and the codebook signal generated in step S430 (S440).

$$u_{fec}(n)=g_{pa}v(n)+g_{ca}rand(n) \quad \text{[Expression 2]}$$

Here, $u_{fec}(n)$ denotes the error-concealed excitation signal, $g_{pa}$ denotes the arbitrary pitch gain (adaptive codebook gain), v(n) denotes the adaptive codebook, $g_{ca}$ denotes the arbitrary codebook gain, and rand(n) denotes the random codebook.

The enhancer 136 is used to remove, from the error-concealed excitation signal $u_{fec}(n)$, artifact which may occur in a low transfer rate mode or which may occur due to insufficient information when error concealment has been applied. First, the enhancer 136 makes the codebook natural through an FIR filter in order to compensate the fixed codebook for a shortage of pulses and adjusts gains of the fixed codebook and the adaptive codebook through a speech characteristics classification process. However, the present invention is not limited to this method.

The short term synthesizer 138 first acquires a spectrum vector $I^{[0]}$ whose arbitrary short term prediction coefficient (or arbitrary linear prediction coefficient) has been converted for the current frame. Here, the arbitrary short term prediction coefficient has been generated in order to replace the received short term prediction coefficient since an error has occurred in data of the current frame. The arbitrary short term prediction coefficient is generated based on a short term prediction coefficient of a previous frame (including an immediately previous frame) and may be generated according to the following expression although the present invention is not limited thereto.

$$I^{[0]}=\alpha I^{[-1]}+(1-\alpha)I_{ref} \quad \text{[Expression 3]}$$

Here, $I^{[0]}$ denotes an Immittance Spectral Frequency (ISP) vector corresponding to the arbitrary short term prediction coefficient, $I^{[-1]}$ denotes an ISP vector corresponding to a short term prediction coefficient of a previous frame, $I_{ref}$ denotes an ISP vector of each order corresponding to a stored short term prediction coefficient, and α denotes a weight.

The short term synthesizer 138 performs short term prediction synthesis or linear prediction (LPC) synthesis using the arbitrary short term spectrum vector $I^{[0]}$. Here, the STP synthesis filter may be represented by the following expression although the present invention is not limited thereto.

[Expression 4]

$$\frac{1}{S(z)} = \frac{1}{1 - A(z)} = \frac{1}{1 - \sum_{i=1}^{p} a_i z^{-i}} \quad \text{[Expression 4]}$$

Here, $a_i$ is an ith-order short term prediction coefficient.

The short term synthesizer 138 then generates a first temporary output signal using a signal obtained by short term synthesis and the excitation signal generated in step S440 (S460). The first temporary output signal may be generated by passing the excitation signal through the short term prediction synthesis filter since the excitation signal corresponds to an input signal of the short term prediction synthesis filter.

The extrapolator 138-2 performs extrapolation to generate a future signal based on a past signal in order to generate a second temporary output signal for error concealment (S470). Here, the extrapolator 138-2 may perform pitch analysis on a past signal and store a signal corresponding to one pitch period and may then generate a second temporary output signal by sequentially coupling signals in an overlap and add manner through a Pitch Synchronous Overlap and Add (PSOLA) method although the extrapolation method of the present invention is not limited to PSOLA.

The selector 139 selects a target signal of the re-encoder 140 from among the first temporary output signal and the second temporary output signal (S480). The selector 139 may select the first temporary output signal upon determining, through speech characteristics classification of the past signal, that the input sound is unvoiced sound and select the second temporary output signal upon determining that the input sound is voiced sound. A function embedded in a codec may be used to perform speech characteristics classification and it may be determined that the input sound is voiced sound when the long term gain is great and the long term delay value changes little although the present invention is not limited thereto.

Figure 6:
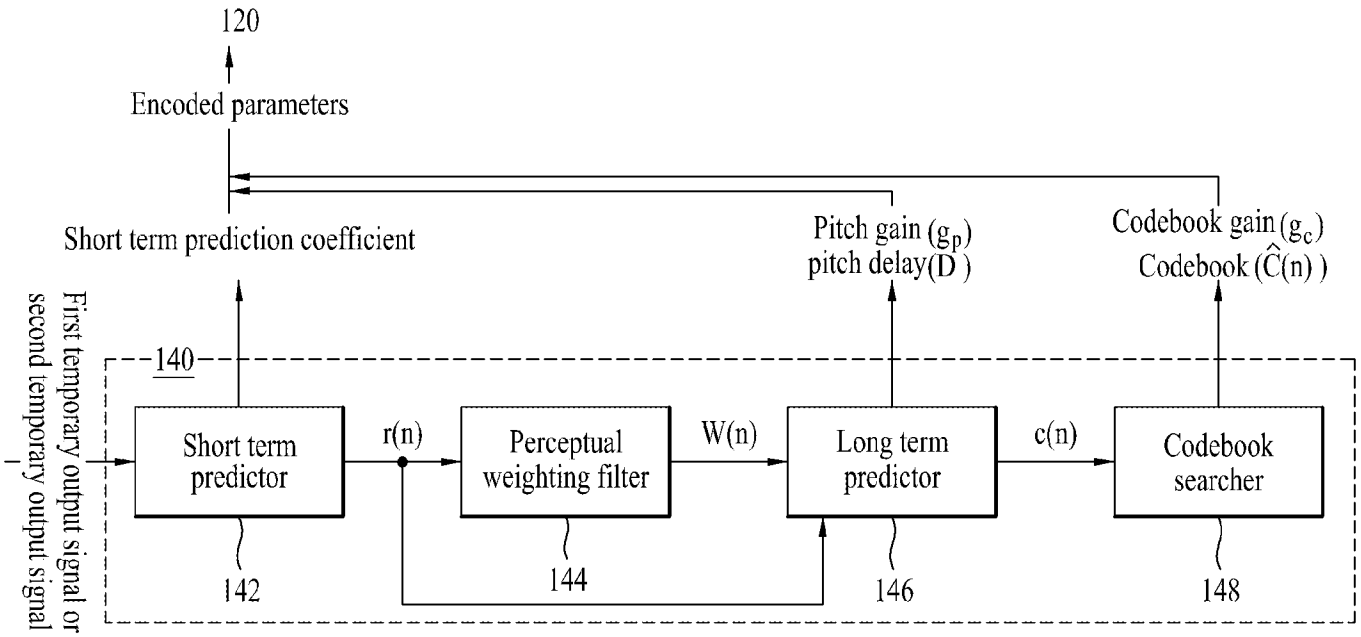
FIG. 6 is a detailed block diagram of a re-encoder 140 according to an embodiment of the present invention.

Hereinafter, the re-encoder 140 is described with reference to FIGS. 6 and 7. FIG. 6 is a detailed block diagram of the re-encoder 140 according to an embodiment of the present invention and FIG. 7 is a flowchart of the re-encoding step S500.

First, referring to FIG. 6, the re-encoder 140 includes at least one of a short term predictor 142, a perceptual weighting filter 144, a long term predictor 146, and a codebook searcher 148.

Figure 7:
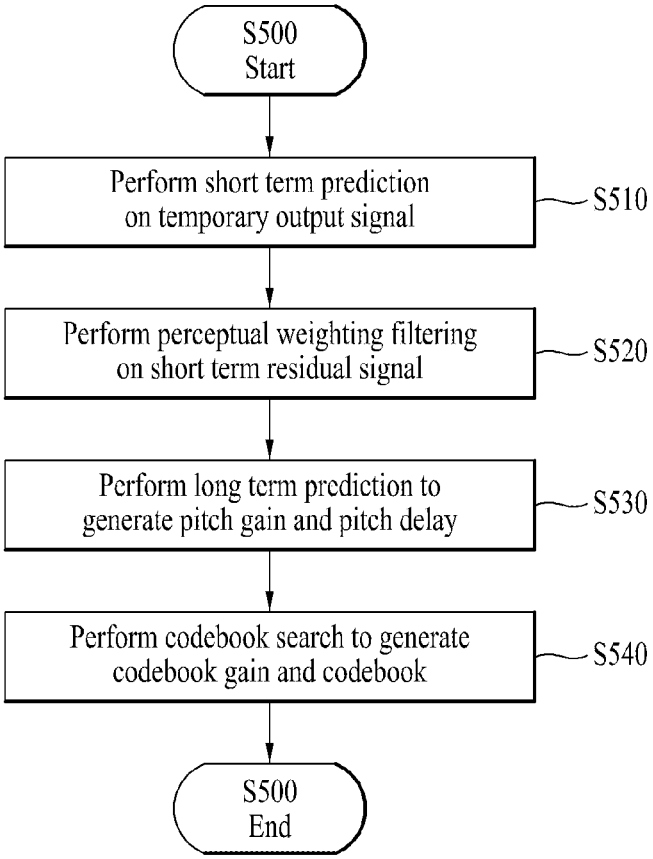
FIG. 7 is a flowchart of re-encoding step S500.

As shown in FIGS. 6 and 7, the short term predictor 142 receives one of the first temporary output signal and the second temporary output signal which are output signals of the error concealment unit 130 described above with reference to FIG. 1 and performs short term prediction analysis on the received signal (S510). Here, a Linear Prediction Coefficient (LPC) may be obtained through short term prediction analysis. The purpose of step S510 is to generate a short term prediction coefficient, which minimizes an error of the short term prediction (STP) filter (i.e., a prediction error corresponding to the difference between original and predicted signals), through short term analysis. Here, for example, it is possible to use the definition of Expression 4 described above.

Then, the perceptual weighting filter 144 applies perceptual weighting filtering to a residual signal r(n) which is the difference between a temporary output signal and a predicted signal obtained through short term prediction (S520). Here, the perceptual weighting filtering may be represented by the following expression.

[Expression 5]

$$W(z) = \frac{A(z/\gamma_1)}{A(z/\gamma_2)} \quad \text{[Expression 5]}$$

Here, $\gamma_1$ and $\gamma_2$ are weights.

It is preferable to use the same weights as used in encoding. For example, $\gamma_1$ may be 0.94 and $\gamma_2$ may be 0.6 although the present invention is not limited thereto.

The long term predictor 146 may obtain a long term prediction delay value D by performing open loop search on a weight input signal to which the perceptual weighting filtering has been applied and perform closed loop search on the long term prediction delay value D within a range of ±d from the long term prediction delay value D to select a final long term prediction delay value T and a corresponding gain (S530). Here, d may be 8 samples although the present invention is not limited thereto.

Here, it is preferable to use the same long term prediction method as used in the encoder.

Specifically, a long term prediction delay value (pitch delay) D may be calculated according to the following expression.

[Expression 6]

$$D = \arg\max_k \left\{ \frac{\sum_{n=0}^{L-1} d(n)d(n-k)}{\sqrt{\sum_{n=0}^{L-1} d(n-k)d(n-k)}} \right\} \quad \text{[Expression 6]}$$

Here, the long term prediction delay D is k which maximizes the value of the function.

The long term prediction gain (pitch gain) may be calculated according to the following expression.

[Expression 7]

$$g_p = \frac{\sum_{n=0}^{L-1} d(n)d(n-D)}{\sum_{n=0}^{L-1} d^2(n-D)}, \text{ bounded by } 0 \le g_p \le 1.2 \quad \text{[Expression 7]}$$

Here, d(n) denotes a long term prediction target signal and u(n) denotes a perceptual weighting input signal, L denotes the length of a subframe, D denotes a long term prediction delay value (pitch delay), and $g_p$ denotes a long term prediction gain (pitch gain).

d(n) may be an input signal x(n) in the closed-loop scheme and may be wx(n) to which the perceptual weighting filtering has been applied in the open-loop scheme.

Here, the long term prediction gain is obtained using the long term prediction gain D that is determined according to Expression 6 as described above.

The long term predictor 146 generates the pitch gain $g_p$ and the long term prediction delay value D through the above procedure and provides a fixed codebook target signal c(n), which is obtained by removing an adaptive codebook signal generated through long term prediction from the short term prediction residual signal r(n), to the codebook searcher 148.

$$c(n)=r(n)-g_p v(n) \quad \text{[Expression 8]}$$

Here, c(n) denotes the fixed codebook target signal, r(n) denotes the short term prediction residual signal, $g_p$ denotes the adaptive codebook gain, and v(n) denotes a pitch signal corresponding to the adaptive codebook delay D.

Here, v(n) may represent an adaptive codebook obtained using a long term predictor from a previous excitation signal memory which may be the memory of the decoder 120 described above with reference to FIG. 1.

The codebook searcher 148 generates a fixed codebook gain $g_c$ and a fixed codebook $\hat{c}(n)$ by performing codebook search on the codebook signal (S540). Here, it is preferable to use the same codebook search method as used in the encoder.

Here, the parameters may be generated in a closed loop manner such that encoded parameters are re-determined taking into consideration results of synthesis processes (such as long term synthesis and short term synthesis) that are performed using the parameters (including the short term prediction coefficient, the long term prediction gain, the long term prediction delay value, the fixed codebook gain, and the fixed codebook) generated in steps S510, S530, and S540.

The parameters generated through the above procedure are provided to the decoder 120 as described above with reference to FIGS. 1 and 2.

Figure 8:
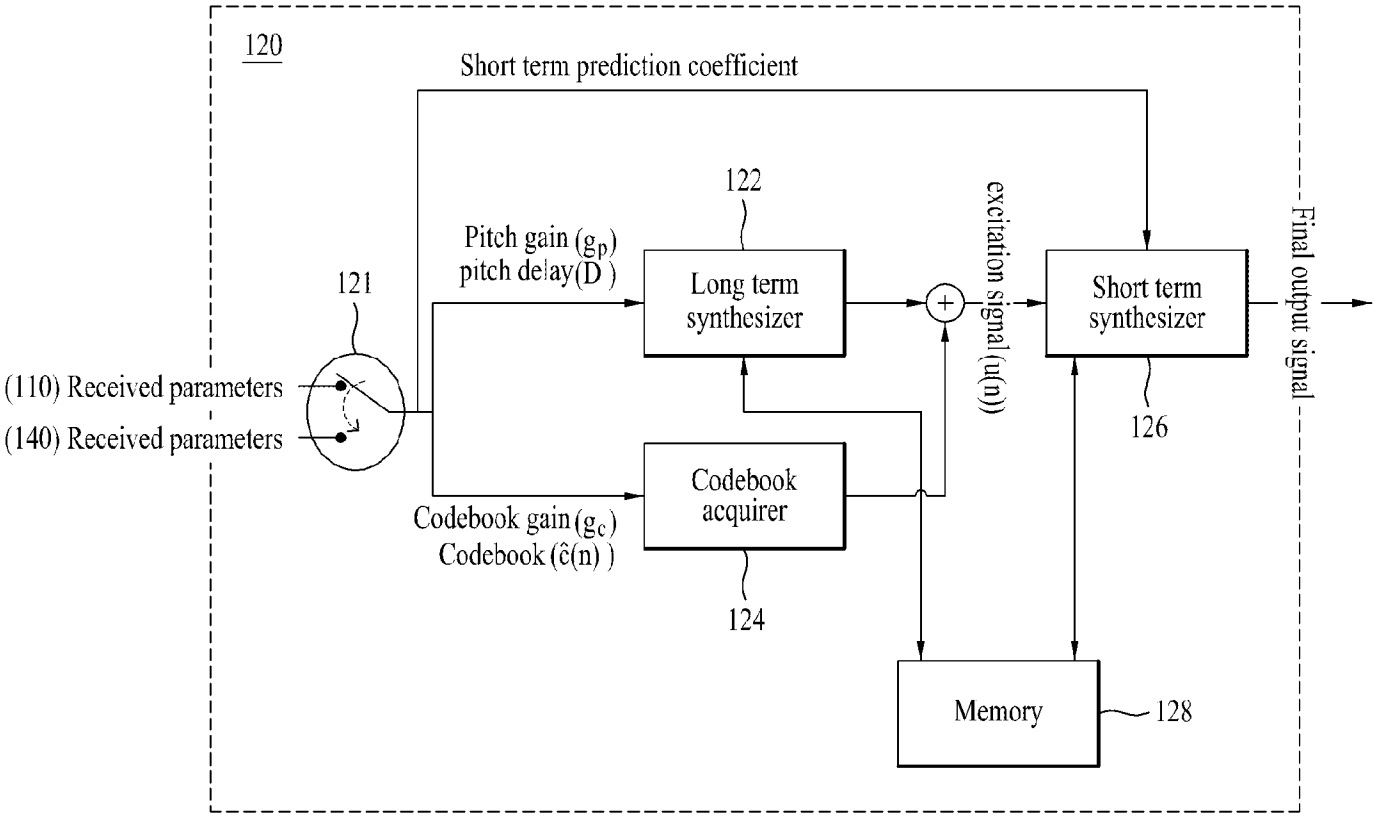
FIG. 8 is a detailed block diagram of a decoder 120 according to an embodiment of the present invention.
Figure 9:
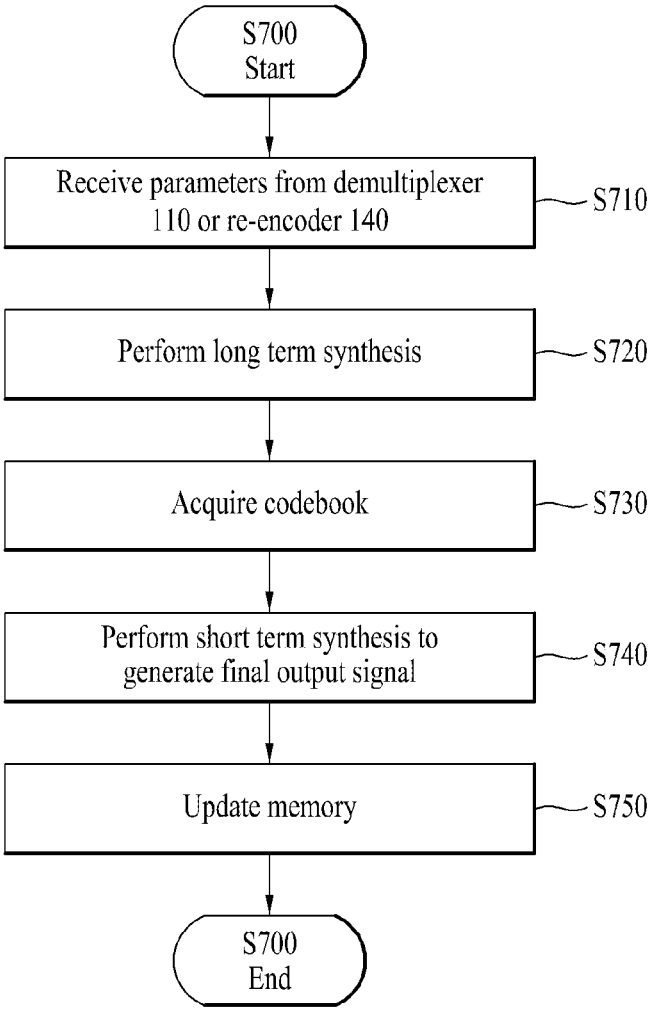
FIG. 9 is a flowchart of encoding step S700.
Figure 10:
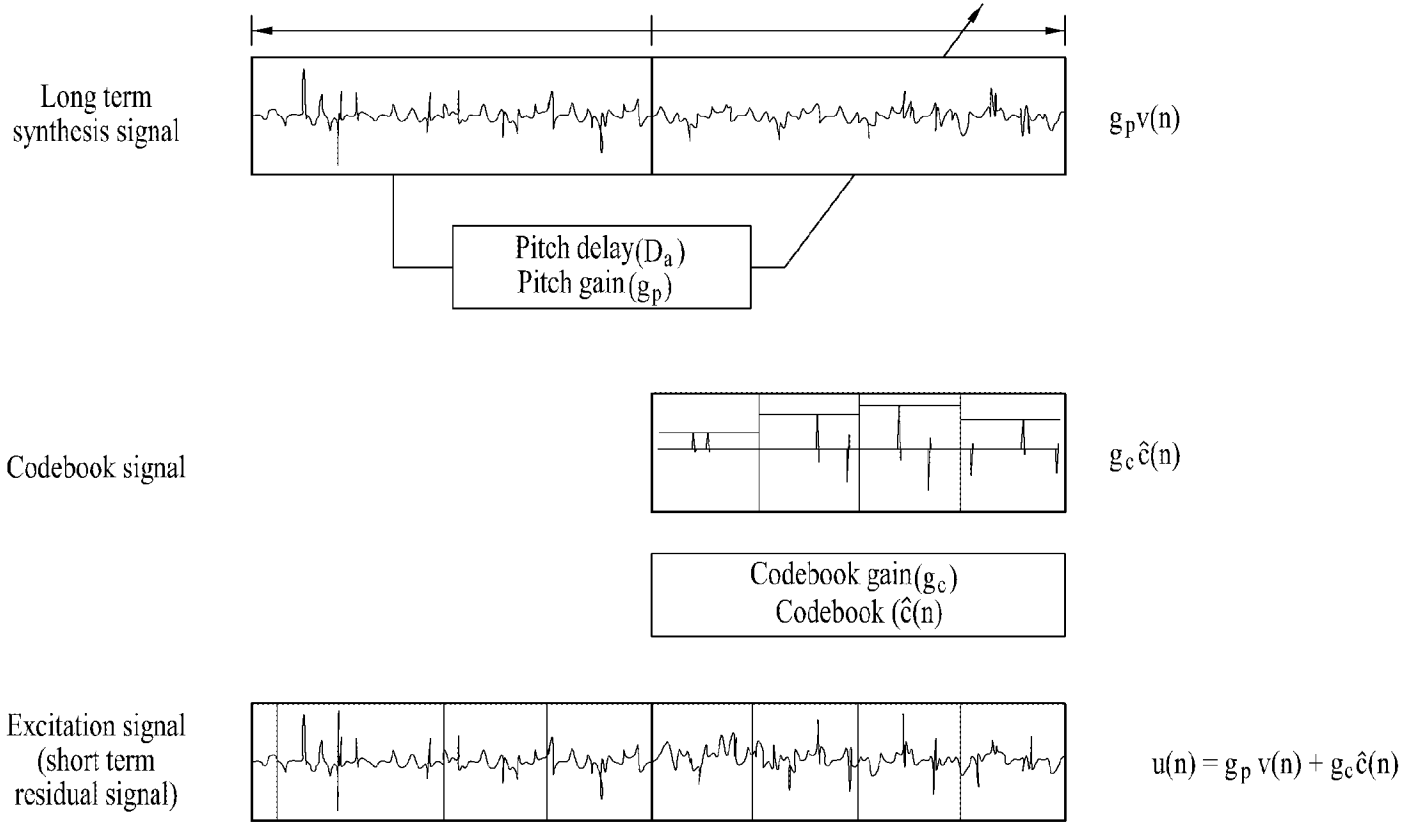
FIG. 10 illustrates a signal generated by a decoder according to an embodiment of the present invention.

FIG. 8 is a detailed block diagram of the decoder 120 according to an embodiment of the present invention and FIG. 9 is a flowchart of the encoding step S700. FIG. 10 illustrates a signal generated by the decoder according to an embodiment of the present invention. First, referring to FIG. 8, the decoder 120 includes a switch 121, a long term synthesizer 122, a fixed codebook acquirer 124, a short term synthesizer 126, and a memory 128.

Referring to FIGS. 8 and 9, the switch 121 receives parameters from the demultiplexer 110 or receives parameters from the re-encoder 140 according to the error check result (BFI) (S710). The parameters received from the demultiplexer 110 are parameters included in a bitstream which have been extracted by the demultiplexer 110. The parameters received from the re-encoder 140 are parameters which have been encoded by the re-encoder 140 after the error concealment unit 130 performs error concealment for an interval (for example, a frame) in which an error has occurred as described above. The following description is given with reference to the latter case in which the parameters are received from the re-encoder 140.

The long term synthesizer 122 performs long term synthesis based on the long term prediction gain $g_p$ and the long term prediction delay D to generate an adaptive codebook (S720). The long term synthesizer 122 is similar to the long term synthesizer 132 described above with the difference being the input parameters. FIG. 10(A) illustrates an exemplary long term synthesis signal $g_p v(n)$ generated using the received pitch gain and the received pitch delay.

The codebook acquirer 124 generates a fixed codebook signal $\hat{c}(n)$ using the received fixed codebook gain $g_c$ and fixed codebook parameter (S730). FIG. 10(B) illustrates an exemplary fixed codebook signal generated using the fixed codebook gain and the fixed codebook index.

An excitation signal u(n) is generated by summing the pitch signal and the codebook signal. FIG. 10(C) illustrates an exemplary excitation signal.

Unlike the random signal generator 134 described above with reference to FIG. 3, the codebook acquirer 124 uses the received fixed codebook rather than a random codebook.

The short term synthesizer 126 performs short term synthesis based on a signal of a previous frame and the short term prediction coefficient and adds the excitation signal u(n) to the short term synthesis signal to generate a final output signal (S740). Here, the following expression may be applied.

$$u(n)=g_p v(n)+g_c \hat{c}(n) \quad \text{[Expression 9]}$$

Here, u(n) denotes an excitation signal, $g_p$ denotes an adaptive codebook gain, v(n) denotes an adaptive codebook corresponding to a pitch delay D, $g_c(n)$ denotes a fixed codebook gain, and $\hat{c}(n)$ denotes a fixed codebook having a unit size.

A detailed description of operation of the short term synthesizer 126 is omitted herein since it is similar to operation of the short term synthesizer 138 described above with reference to FIG. 3.

Then, the memory 128 is updated with the received parameters, signals generated based on the parameters, the final output signal, and the like (S750). Here, the memory 128 may be divided into a memory 128-1 (not shown) for error concealment and a memory 128-2 (not shown) for decoding. The memory 128-1 for error concealment stores data required for the error concealment unit 130 (for example, a long term prediction gain, a long term prediction delay value, a past delay value history, a fixed codebook gain, and a short term prediction coefficient) and the memory 128-2 for decoding stores data required for the decoder 120 to perform decoding (for example, an excitation signal of a current frame for synthesis of a next frame, a gain value, and a final output signal). The two memories may be implemented as a single memory 128 rather than being separated. The memory 128-2 for decoding may include a memory for long term prediction and a memory for short term prediction. The memory 128-2 for long term prediction may include a memory required to generate an excitation signal from a next frame through long term synthesis and a memory required for short term synthesis.

In the case in which parameters are received from the demultiplexer 110 through the switch 121 of FIG. 8 when no error has occurred in data of a next frame, one of long term synthesis 122 and short term synthesis 126 is performed on the next frame based on data of the memory updated in step S750.

By updating data of a frame which contains an error with parameters corresponding to an error-concealed signal in the above manner, it is possible to prevent error propagation as much as possible upon decoding of the next frame.

The audio signal processing method according to the present invention may be implemented as a program to be executed by a computer and the program may then be stored in a computer readable recording medium. Multimedia data having a data structure according to the present invention may also be stored in a computer readable recording medium. The computer readable recording medium includes any type of storage device that stores data that can be read by a computer system. Examples of the computer readable recording medium include read only memory (ROM), random access memory (RAM), CD-ROMs, magnetic tapes, floppy disk, optical data storage devices, and so on. The computer readable recording medium can also be embodied in the form of carrier waves (for example, signals transmitted over the Internet). A bitstream generated through the encoding method described above may be stored in a computer readable recording medium or may be transmitted over a wired/wireless communication network.

Although the present invention has been described above with reference to specific embodiments and drawings, the present invention is not limited to the specific embodiments and drawings and it will be apparent to those skilled in the art that various modifications and variations can be made in the present invention without departing from the spirit of the invention and the scope of the appended claims and their equivalents.

INDUSTRIAL APPLICABILITY

The present invention is applicable to audio signal processing and output.

What is claimed is:

1. A method for processing an audio signal by an audio signal processing device, the method comprising:

receiving, with the audio signal processing device, an arbitrary fixed codebook gain of a previous frame and a short term prediction coefficient of the previous frame from the audio signal;

checking, with the audio signal processing device, whether a current frame has an error based on a bad frame indicator;

generating, with the audio signal processing device, an arbitrary fixed codebook gain of the current frame using the arbitrary fixed codebook gain of the previous frame;

generating, with the audio signal processing device, a short term spectral vector of the current frame using the short term prediction coefficient of the previous frame; and generating, with the audio signal processing device, an error-concealed excitation signal using the arbitrary fixed codebook gain of the current frame and the short term spectral vector of the current frame.

2. The method according to claim 1, further comprising:

receiving, with the audio signal processing device, a pitch gain of the previous frame and a pitch delay of the previous frame from the audio signal;

generating, with the audio signal processing device, a pitch gain of the current frame and a pitch delay of the current frame using the pitch gain of the previous frame and the pitch delay of the previous frame when the current frame has an error; and generating, with the audio signal processing device, an adaptive codebook using the pitch gain of the current frame and the pitch delay of the current frame, wherein the error-concealed excitation signal is generated using the adaptive codebook.

3. The method according to claim 1, wherein generating the short term spectral vector of the current frame comprises:

obtaining, with the audio signal processing device, a weight and a reference short term spectral vector; and generating, with the audio signal processing device, the short term spectral vector of the current frame using the weight and the reference short term spectral vector and the short term prediction coefficient of the previous frame.

4. The method according to claim 1, further comprising:

generating, with the audio signal processing device, a fixed codebook using the arbitrary fixed codebook gain of the current frame, wherein the error-concealed excitation signal is generated using the fixed codebook.

5. An audio signal processing device comprising:

a demultiplexer configured to receive an arbitrary fixed codebook gain of a previous frame and a short term prediction coefficient of the previous frame from the audio signal;

an error concealment unit configured to perform operations comprising:

checking whether a current frame has an error based on a bad frame indicator; and generating an arbitrary fixed codebook gain of the current frame using a fixed codebook gain of the previous frame;

a decoder configured to generate an error-concealed excitation signal using the arbitrary fixed codebook gain of the current frame and a short term prediction coefficient of the previous frame; and a re-encoder configured to perform operations comprising:

receiving the short term prediction coefficient of the previous frame from the audio signal;

generating a short term spectral vector of the current frame using the short term prediction coefficient of the previous frame; and generating a temporary output signal using the short term spectral vector of the current frame and the error-concealed excitation signal.

6. The audio signal processing device according to claim 5, wherein the re-encoder is configured to perform operations further comprising:

obtaining a weight and a reference short term spectral vector; and generating the short term spectral vector of the current frame using the weight and the reference short term spectral vector and the short term prediction coefficient of the previous frame.

7. The audio signal processing device according to claim 5, wherein the error concealment unit is further configured to generate a fixed codebook using the arbitrary fixed codebook gain of the current frame, wherein the error-concealed excitation signal is generated using the fixed codebook.

8. The audio signal processing device according to claim 5, further comprising:

a memory configured for to be updated with the short term spectral vector of the current frame and the temporary output signal.

* * * * *